United States Patent [19]

Dohanic, Jr. et al.

[11] 3,972,017

[45] July 27, 1976

[54] DC POTENTIAL CONTROLLER

[75] Inventors: John L. Dohanic, Jr., Girard; Gerald J. Cornell, Lake City, both of Pa.

[73] Assignee: Louis Marx & Co., Inc., Glen Dale, W. Va.

[22] Filed: July 22, 1975

[21] Appl. No.: 597,932

[52] U.S. Cl. ..... 338/165; 46/45; 104/152; 338/118; 338/171; 338/184

[51] Int. Cl.[2] ..... H01C 5/02

[58] Field of Search ..... 338/165, 118, 128, 160, 338/162, 171, 184; 46/45, 243 M, 243 LV; 272/31 A; 104/152, 148 R; 191/3

[56] References Cited

UNITED STATES PATENTS

| | | | |
|---|---|---|---|
| 910,702 | 1/1909 | Marshall | 104/152 X |
| 2,317,402 | 4/1943 | Penrose | 338/165 |
| 3,160,845 | 12/1964 | Hoshinomiya | 338/184 X |

*Primary Examiner*—C. L. Albritton
*Attorney, Agent, or Firm*—Blum, Moscovitz, Friedman & Kaplan

[57] ABSTRACT

A D.C. potential controller is provided for controlling the magnitude and polarity of a D.C. potential applied to a D.C. drive motor. The controller includes a supply device for producing a potential having a predetermined polarity and magnitude and including a first fixed terminal referenced to said predetermined polarity and potential and a second fixed terminal referenced to a reference potential. A regulating element is displaceable between first and second polarity selecting positions, and is further coordinately displaceable from either first or second polarity selecting positions through a third position. The regulating element also includes first and second moving contacts disposed thereon in spaced apart relationship for contact with the first and second terminals, first and second fixed output current terminals are respectively disposed in contact with the first and second moving contacts when same are displaced through the third position, the first output current terminal including circuitry for linearly varying the output current in the first output current terminal in response to the aforesaid coordinate displacement of the regulating member.

10 Claims, 6 Drawing Figures

DC POTENTIAL CONTROLLER

BACKGROUND OF THE INVENTION

This invention is directed to a D.C. potential controller and in particular to a D.C. potential controller for regulating the magnitude and polarity of a potential applied to a D.C. drive motor to control the driving thereof. While D.C. potential controller arrangements for use in driving D.C. motor driven toys such as electric trains, slide cars and the like have taken on various forms, simplified control arrangements wherein a single movable element is adapted to selectively apply and determine the magnitude and polarity of the D.C. potential applied to the drive motor have been less than completely satisfactory due to the numerous moving parts and complexity required to effect same. Accordingly, a simple D.C. potential contoller utilizing a single moving element for selectively applying and varying the magnitude and polarity of a D.C. potential to be applied to a D.C. drive motor is desired.

SUMMARY OF THE INVENTION

Generally speaking, in accordance with the instant invention, a D.C. potential controller arrangement particularly adapted for regulating the magnitude and polarity of a potential applied to a D.C. drive motor is provided. The controller includes a supply circuit for producing a potential having a predetermined polarity and magnitude. The supply circuit includes a first fixed terminal referenced to a predetermined polarity and potential and a second fixed terminal referenced to a reference potential. A control circuit for selectively producing a potential of varying magnitude and polarity includes a regulating element displaceable between first and second polarity selecting positions and being coordinately displaceable from either the first or second polarity selecting position through a third position. First and second moving contacts are disposed on said regulating element in spaced apart relationship, to contact the first and second fixed terminals during coordinate displacement of same. First and second fixed output current terminals are respectively disposed in contact with the first and second moving contacts when same are displaced through said third position. The first fixed output current terminal includes circuitry for linearly varying the current therein in response to the aforesaid coordinate displacement of the regulating member through the third position.

Accordingly, it is an object of this invention to provide an improved D.C. potential controller arrangement for regulating the magnitude and polarity of a potential applied to a D.C. drive motor.

It is a further object of this invention to provide a D.C. potential controller having a single movable element for selectively applying and regulating the magnitude and polarity of a D.C. potential applied to a utilization device.

Still another object of the instant invention is to provide a simple and inexpensive D.C. potential controller arrangement particularly suitable for use in D.C. motor driven toys such as electric trains, slot cars and the like.

Still other objects and advantages of the invention will in part be obvious and will in part be apparent from the specification.

The invention accordingly comprises the features of construction, combinations of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
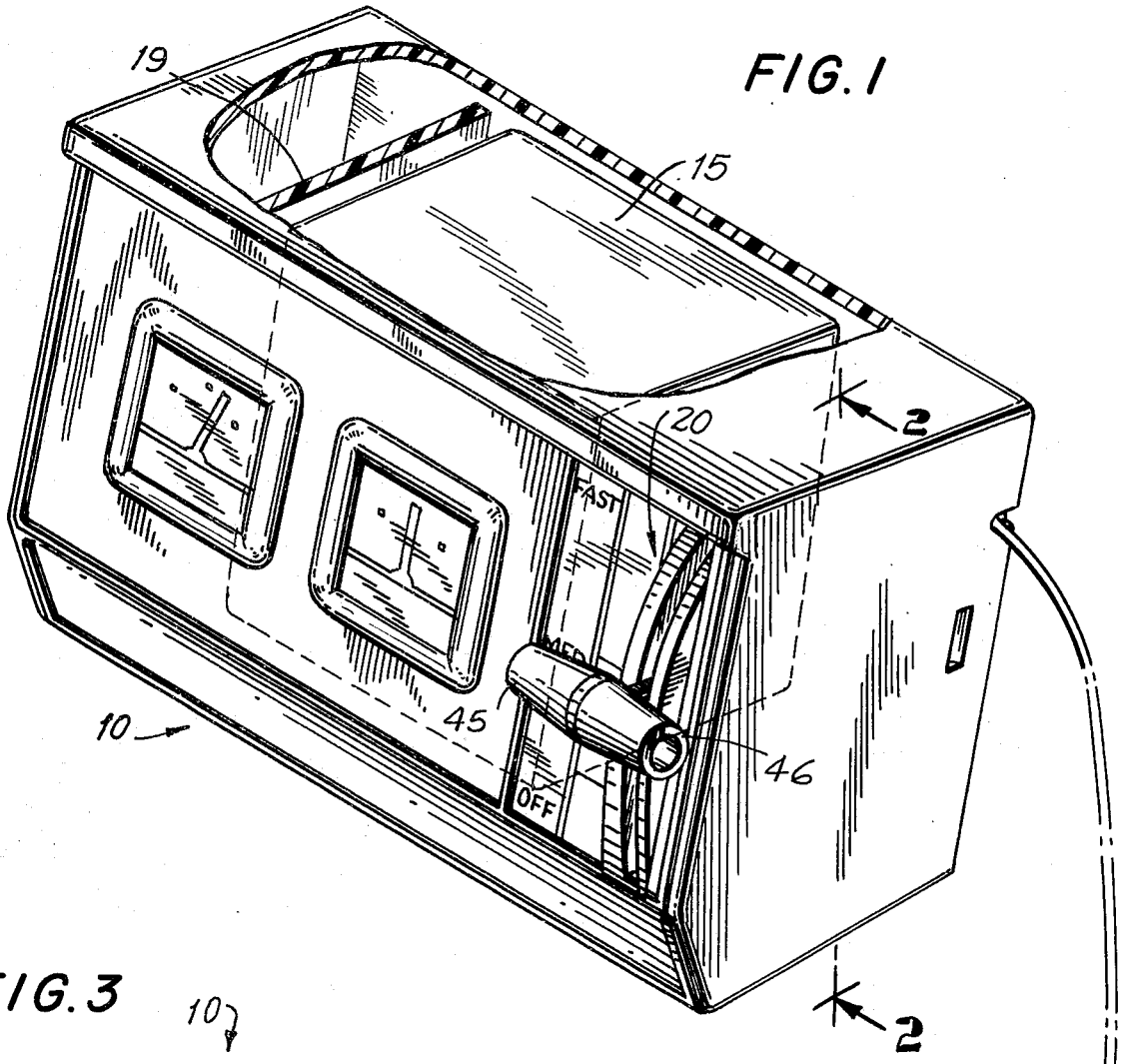
FIG. 1 is part perspective, part broken-away view of a toy electric train D.C. control panel including a D.C. potential controller constructed in accordance with the instant invention.
Figure 2:
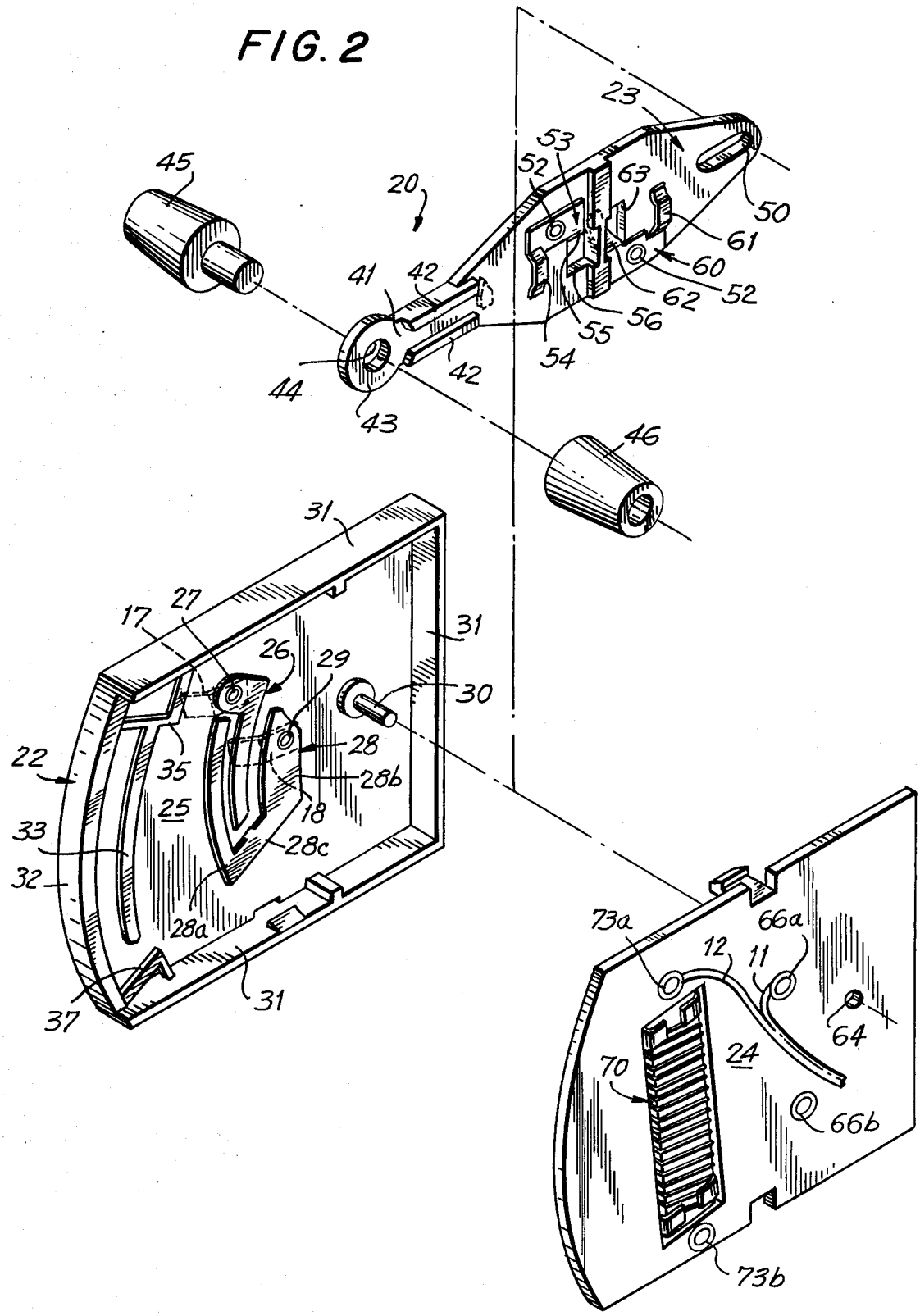
FIG. 2 is an exploded view of a D.C. potential controller constructed in accordance with the instant invention.

Referring now to FIG. 1, a toy electric train control panel, generally indicated at 10, is depicted. The toy electric train control panel releasably supports a 6-volt lantern battery 15 and a D.C. potential controller, generally indicated at 20. D.C. controller 20 controls the magnitude and polarity of a D.C. potential applied through leads 11 and 12 to contacts 13 and 14 electrically coupled to the rails of an electric train track (illustrated in phantom) to effect driving of a D.C. drive motor contained in a toy electric train (not shown) in a conventional manner. The D.C. potential controller applies the D.C. potential in response to the 6-volt lantern battery 15 positionally secured in contact with the D.C. controller 20 by positioning wall 19 and resilient battery lead coils **16*a* and 16*b*. D.C. potential controller 20 includes resilient leads 17 and 18, illustrated in phantom in FIG. 2, for coupling the D.C. controller to the battery 15. Accordingly, resilient lead 17 is coupled through lead coil 16*a* to the positive (+) potential of the battery and a resilient lead 18 is coupled to the negative (−) potential of the battery through lead coil 16*b*. The 6-volt battery is therefore received by the control panel and is maintained in electrical contact with the D.C. potential controller 20, without need of further supporting and/or circuit elements. It is noted that the 6-volt lantern battery 15** is shown by way of example only, and that the D.C. potential controller of the instant invention is suitable for use with any source of D.C. potential. Accordingly, conventional A.C. to D.C. converter circuitry for allowing the control panel to be utilized with conventional A.C. line supply current could also be utilized in accordance with the D.C. potential controller of the instant invention.

Reference is now made of FIGS. 2 through 6, wherein the D.C. potential controller 20, constructed in accordance with the instant invention, is depicted. A regulating lever 23 is supported in a housing defined by input terminal support member, generally indicated as 22, and an output current support member, generally indicated as 24. The input terminal support member 22 includes fixed contact supporting wall 25 for supporting fixed conductive contacts 26 and 28 thereon. Fixed contact 26 is secured to a supporting wall 25 by rivet 27, which rivet extends through support wall 25 and additionally secures resilient lead 17 to the outer surface of the housing to thereby reference fixed contact 26 to a positive (+) potential. Fixed contact 28 is substantially U-shaped and includes a first arcuate leg 28*a*, a second arcuate leg 28*b* and a bridge portion 28*c*, each of said respective portions of said fixed contact 28 being disposed in spaced apart relation to fixed contact 26 and hence insulated therefrom. Fixed contact 28 is secured to supporting wall 25 by rivet 29, which rivet extends through the supporting wall to the outer surface of the housing and secures resilient lead 18 to the support wall to thereby reference fixed contact 28 to a negative (−) potential. A post 30 for supporting regulating lever 23 is integrally formed on supporting wall 25 and projects perpendicularly therefrom.

Input terminal support member 22 includes a wall 31 transversely disposed with respect to support wall 25 to define the housing's top, bottom and rear walls. Input terminal support member 22 further includes a narrow transverse front wall 32 defining an elongated opening to allow regulating lever 23 to extend from the housing. Spaced inwardly from transverse front wall 32 is an arcuate guide wall 33 defining a guide channel 34 between same and front wall 32. A first end of guide wall 33 intersects a top guide wall 35, which top guide wall closes off guide channel 34. The end 36 of the guide wall 33 and a bottom guide wall 37 spaced apart from the end of guide wall 36 define an escapement channel 38 to be explained with greater particularity below.

Regulating lever 23 includes a narrow portion 41, which narrow portion extends through the elongated housing opening defined by transverse front wall 32 and the output support member 24. Spacers 42 are disposed on the narrow portion of regulating lever 23 to prevent the regulating lever 23 from wobbling and thereby maintain the respective conductive elements of the D.C. potential controller in firm electrical contact during operation. Narrow portion 41 terminates in a loop 43 having an aperture 44 therein for receiving interfitting knob-halves 45 and 46 therein. Knob-halves 45 and 46 facilitate assembly of a toy control panel including a D.C. potential controller by enabling such a controller to be inserted from the rear of the control panel whereafter the knob-halves are interfit in aperture 44 to simulate a T-bar control.

Coordinate displacement of the regulating lever 23 in the housing is effected by an elongated slot 50 formed in regulating lever 23 to support same on post 30, and a projection 51 disposed on regulating lever 23 for guiding the displacement thereof. Elongated slot 50 allows longitudinal displacement between first and second positions defined by the lengthwise ends of the slot and pivoting displacement of regulating lever 23 about post 30 in either longitudinally displaced position. As illustrated in phantom in FIG. 3, projection 51 on regulating lever 23 permits longitudinal displacement of same only when the regulating lever is pivoted to a position where the projection 51 can be displaced in escapement channel 38. The triangular cross-section of the upper facing portion of projection 51 causes same to position the regulating lever in a first outer displaced position or second inner displaced position as same is pivoted upward by causing projection 51 to be deflected by the rounded end 36 of the guide wall 33. Once the regulating lever is pivoted upward so that the projection 51 is disposed on the outer or inner side of guide wall 33 such as in the guide channel 34, longitudinal displacement of the regularing lever is not possible. Accordingly, projection 51 assures that regulating lever can only be longitudinally displaced between a first outer and second inner position when regulating lever 23 is in the position illustrated in phantom in FIG. 3, and thus when pivoted through a third position from the respective first and second displaced positions, regulating lever 23 must first be returned to the respective first or second position from which same was pivoted before a further longitudinal displacement can be effected.

First and second U-shaped moving contacts, generally indicated as 53 and 60, are respectively secured to a first side of regulating lever 23 by rivits 52. A first leg 54 of first moving contact 53 is bent to define a contact element on the first side of regulating lever 23 and a second leg 55 is bent through an aperture 56 in regulating lever 23 to define a resilient contact element on the other side of the regulating lever. Similarly, a first resilient leg 61 of second moving contact 60 is bent to define a contact element on the first side of the regulating lever, and a second leg 62 is bent back through an aperture 63 to thereby define a contact element on the other side of the regulating lever 23. The respective contact elements defined by second legs 55 and 62 of first and second moving contacts 53 and 60 are spaced apart at the same predetermined distance that fixed contacts 26 and 28 are spaced apart to guarantee that same are in contact when regulating lever 23 is at one of the above mentioned displaced positions, as is more fully discussed below with respect to the operation of the instant invention.

The output terminal support member 24 is adapted to be releasably secured to input terminal support member 22 to define the entire housing of the D.C. potential controller 20. The output support member 22 includes an aperture 64 adapted to receive post 30 and prevent regulating lever 23 from being removed therefrom.

A conductive strip 65 is secured to support wall 24 by rivets 66*a* and 66*b*, which rivets extend through to the outer surface of the support wall. Rivet 66*a* couples conductive strip 65 to lead wire 11. Conductive strip 65 is provided with sufficient width and length so that the contact element defined by first leg 61 of second moving contact 60 is in conductive contact therewith at all pivoted positions of the regulating lever 23. An opening 69 is formed in output terminal support wall 24 for receiving a rheostat assembly, generally indicated as 70. The rheostat assembly 70 includes an elongated insulator 71 having a coil 72 wrapped therearound, the insulator and coil wrapped therearound being positionally secured on the support wall by conductive clips 74, which clips are secured to the outer surface of support wall 24 by rivets 73*a* and 73*b*. Rivet 73*b* is coupled at the outer surface of support wall 24 to lead wire 12 to thereby couple rheostat coil 72 through clip 74 and rivet 73*a* to lead wire 12. Insulator 71 is formed of sufficient width to guarantee that the contact element defined by the first leg 54 of first U-shaped moving contact 53 is in contact with the coil 76 wrapped around the insulator at all pivoted positions of regulating lever 23.

Figure 3:
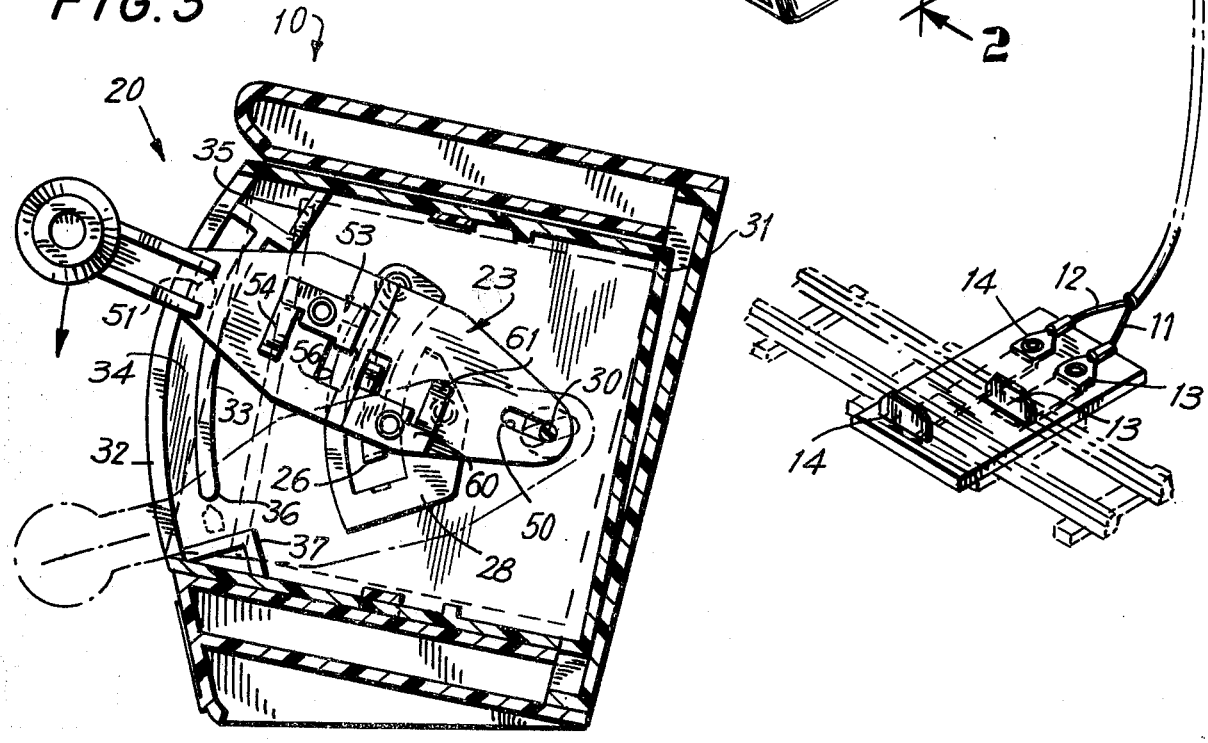
FIG. 3 is a sectional view taken along line 3 — 3 of FIG. 1.

In operation, when regulating lever 23 is in the position indicated by solid lines in FIG. 3, the contact element defined by second leg 55 of moving contact 53 is in contact with the arcuate portion 28*a* of fixed contact 28, which fixed contact as noted above is referenced to a negative (−) potential by resilient lead 18. Similarly, the contact element defined by the second leg 62 of moving contact 60 is disposed in contact with the arcuate portion of fixed contact 26, which contact is referenced to the positive (+) potential by resilient lead 18. Accordingly, since the contacting element defined by first leg 54 of moving contact 53 is in contact with the coil 72 of rheostat 70, and the contacting element defined by the first leg 61 of second moving contact 60 is in contact with conductive strip 65, a first current path defined by resilient lead 18, fixed contact 28, moving contact 53, rheostat 70 and lead wire 12 and a second conductive path defined by resilient lead 17, fixed contact 26, moving contact 60, conductive strip 65 and lead wire 11 thereby produce at contacts 13 and 14 a D.C. potential having a predetermined polarity and magnitude. The magnitude of the D.C. potential is varied by pivoting regulating lever 23 to thereby vary the position at which moving contact 53 contacts the coil 76 of rheostat 70. The closer the position of contact to the rivet 73*a*, the more current that is applied through lead 12, and hence the greater the magnitude of the D.C. voltage. To apply an effective zero potential across the respective contacts 13 and 14, the regulating lever 23 is pivoted to the position indicated in phantom in FIG. 3, to thereby maximize the impedance of rheostat coil 76 and thereby apply an insufficient current to produce a detectable voltage at the respective contacts 13 and 14.

Alternatively, one of the moving contact elements can be positioned out of contact with the respective fixed contacts 26 and 28 when the regulating lever 23 is pivoted to the position illustrated in phantom in FIG. 3 to thereby define an open circuit and produce a zero potential across respective contacts 13 and 14.

Figure 4:
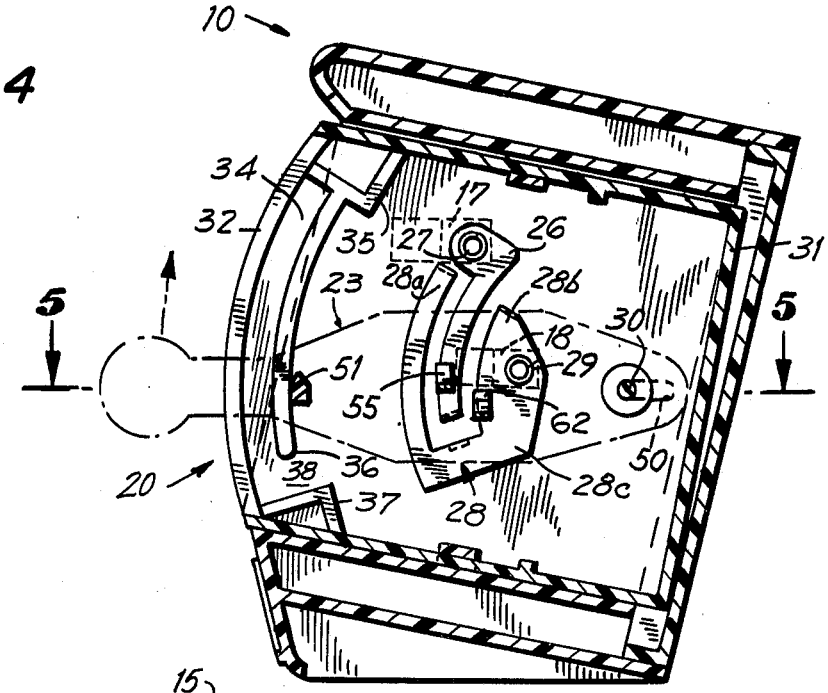
FIG. 4 is the same sectional view depicted in FIG. 3 with the regulating lever illustrated in phantom.
Figure 5:
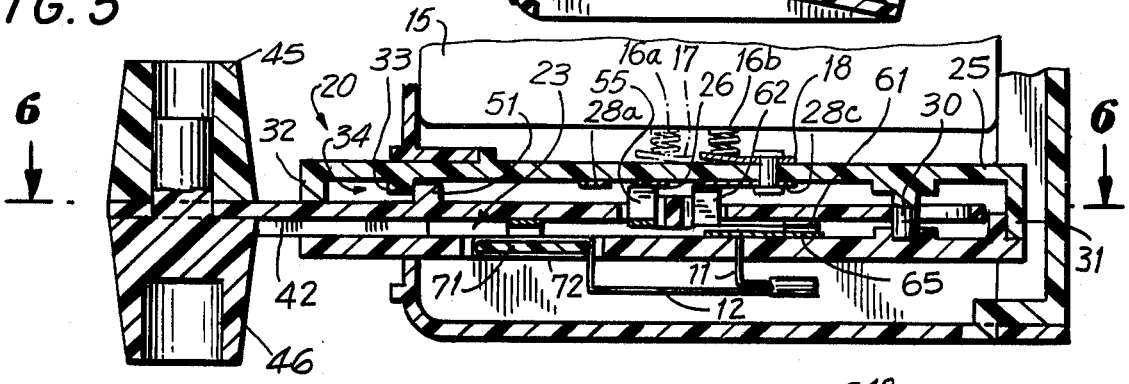
FIG. 5 is a sectional view taken along line 5 — 5 of FIG. 4.
Figure 6:
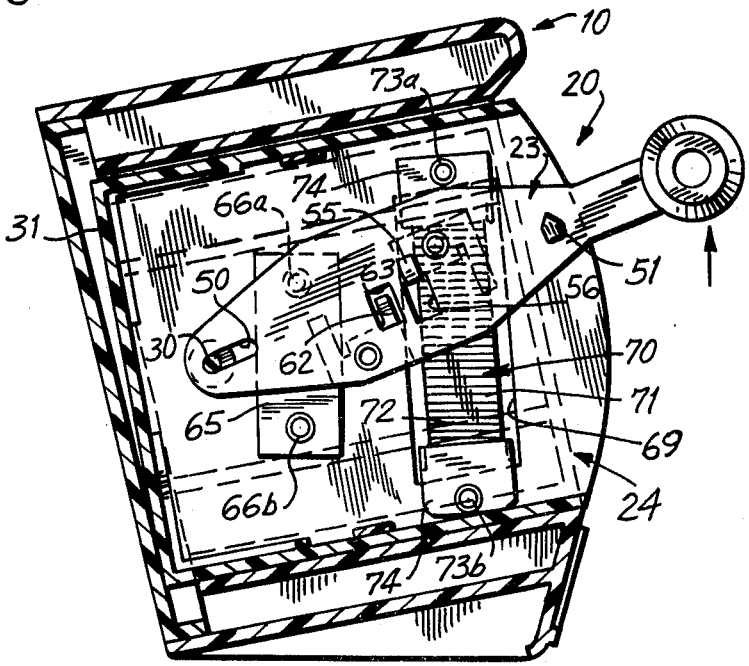
FIG. 6 is a sectional view taken along line 6 — 6 of FIG. 5.

In order to reverse the polarity of the potential applied to contacts 13 and 14, regulating lever 23 is displaced inwardly and thereafter pivoted upwardly as indicated in phantom in FIG. 4. By inwardly displacing regulating lever 23, moving contact 53 is placed in contact with fixed contact 26 referenced to a positive (+) potential and moving contact 60 is placed in contact with fixed contact 28 and is referenced to a negative (−) potential, and the polarity of the D.C. potential applied through rheostat 70 and conductive strip 65 to the output leads 12 and 11 reversed. Because moving contact 55 remains in contact with rheostat coil 76 when the regulating lever is pivoted in the inner displaced position as well as in the outer displaced position, the current in lead 12, and hence the D.C. potential at the output of leads 11 and 12 is varied in the same manner as in the opposite polarity potential mode of operation discussed above. Moreover, by preventing inward and outward displacement of regulating lever 23 unless same is at the polarity selecting position indicated in phantom in FIG. 3, sudden reverses in the polarity of an effective D.C. drive potential applied at contacts 13 and 14 and the damage which such a sudden change in potential could cause to a D.C. motor being driven in response to such D.C. potential are avoided. Accordingly, the D.C. potential controller of the instant invention is characterized by a single regulating lever capable of controlling the occurrence, magnitude and polarity of a D.C. potential in response to a fixed D.C. potential applied thereto.

It will thus be seen that the objects set forth above, among those made apparent from the preceding description, are efficiently attained and, since certain changes may be made in the above construction without departing from the spirit and scope of the invention it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A D.C. potential controller comprising supply means adapted to have a D.C. potential having a predetermined polarity and magnitude applied thereto, said supply means including a first fixed terminal means referenced to said predetermined polarity and potential and a second fixed terminal means referenced to a reference potential, control means for producing a potential of varying magnitude and polarity, said control means including regulating means displaceable between a first and second polarity selecting position, said regulating means being coordinately displaceable from one of said first and second polarity selecting positions through a third position, said regulating means further including first and second moving contacts disposed thereon in spaced apart relationship, each of said moving contacts being electrically coupled to one of said first and second fixed terminals when said regulating means is coordinately displaced through said third position, and first and second output current means disposed in contact with said moving contact means when same are displaced through said third position, said first output current means including means for linearly varying the current therein in response to said coordinate displacement of said regulating means through said third position.

2. A D.C. potential controller as claimed in claim 1, and including support means, said respective first and second fixed supply terminal means being fixedly secured to said support means so that same are electrically coupled to said first and second moving contact means when said regulating means is coordinately displaced from said first position through said third position, and are respectively coupled to said second and first moving contact means when said regulating means is coordinately displaced from said second position through said third position.

3. A D.C. potential controller as claimed in claim 2, wherein said regulating means is displaceably secured to said support means to allow same to be longitudinally displaced between said first and second positions, and to be pivotally coordinately displaced from one of said first and second longitudinally displaced positions through said third position.

4. A D.C. potential controller as claimed in claim 3, wherein said first fixed supply terminal means is a substantially arcuately shaped conductor, and said second fixed supply terminal means is substantially U-shaped conductor, the legs thereof being substantially arcuately shaped and equally spaced apart on each side of said first conductor along the coextensive portions of the respective conductors.

5. A D.C. potential controller as claimed in claim 2, wherein said regulating means is an elongated lever displaceably secured to said support means to allow same to be pivoted through said third displaceable position from one of said first and second polarity selecting positions, said moving contact means being disposed in spaced apart relationship along the longitudinal extent of said lever means to maintain same in contact with said respective first and second fixed supply means during pivoting displacement of said lever through said third displaced position.

6. A D.C. potential controller as claimed in claim 5, wherein said lever is displaceably secured to said support member in such manner as to allow same to be longitudinally displaceable between said first and second displaced positions, said regulating lever and support means including operative means for preventing longitudinal displacement of said regulating lever between said first and second displaced positions when said lever is being pivotally displaced through said third position.

7. A D.C. potential controller as claimed in claim 6, wherein said first output current means is disposed on said support means and is of sufficient longitudinal extent to be maintained in electrical contact with said first moving contact means during pivoting of said lever through said third displaced position, said first output current means for linearly varying the current including variable impedance means having an output terminal, the current produced at the output terminal being linearly increased as said first moving contact means is moved toward said output terminal by pivoting of said lever through said third position thereby decreasing the impedance between said output terminal and said first moving contact means.

8. A D.C. potential controller as claimed in claim 7, wherein said variable impedance means is a rheostat coil.

9. A D.C. potential controller as claimed in claim 7, wherein said second output current means includes a conductor secured to said support means, said conductor being disposed in contact with said second moving contact means during coordinate pivoting of same from said first and second displaced positions through said third position.

10. A D.C. potential controller as claimed in claim 7, wherein said support means includes a first member for supporting said first and second fixed supply terminal means on a first side of said lever means, and a further support member for supporting said respective first and second output current means on the other side of said regulating means, said moving contact means being disposed on the two sides of said lever means facing said respective support members.

* * * * *